US010512298B2

(12) United States Patent
Hatfield et al.

(10) Patent No.: US 10,512,298 B2
(45) Date of Patent: Dec. 24, 2019

(54) FOOTWEAR UPPER WITH LACE-ENGAGED ZIPPER SYSTEM

(71) Applicant: NIKE, Inc., Beaverton, OR (US)

(72) Inventors: Tinker L. Hatfield, Portland, OR (US); Tiffany A. Beers, Portland, OR (US); John T. Dimoff, Portland, OR (US); Jared M. Kilmer, Vancouver, WA (US); Ami M. Davis, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 7 days.

(21) Appl. No.: 15/983,563

(22) Filed: May 18, 2018

(65) Prior Publication Data

US 2018/0338566 A1 Nov. 29, 2018

Related U.S. Application Data

(60) Provisional application No. 62/510,043, filed on May 23, 2017.

(51) Int. Cl.
*A43C 11/12* (2006.01)
*A43B 11/00* (2006.01)
(Continued)

(52) U.S. Cl.
CPC ..... *A43B 11/00* (2013.01); *A43B 3/0036* (2013.01); *A43B 3/242* (2013.01); *A43B 7/20* (2013.01);
(Continued)

(58) Field of Classification Search
CPC ..... A43C 11/008; A43C 11/12; A43B 11/00
(Continued)

(56) References Cited

U.S. PATENT DOCUMENTS 4,497 A 5/1846 Vetter
75,048 A 3/1868 Perley
(Continued)

FOREIGN PATENT DOCUMENTS

CN 87209219 U 5/1988
CN 87103983 A 12/1988
(Continued)

OTHER PUBLICATIONS

Aidin H., Under Armour's Innovative Fall/Winter 2016 Collection Now Available at All Brand Houses, Aug. 27, 2016, https://www.runsociety.com/news/under-armours-innovative-fallwintere-2016-collection-now-available-at-all-brand-houses/ (accessed Nov. 4, 2017).
(Continued)

*Primary Examiner* — Marie D Bays
(74) *Attorney, Agent, or Firm* — Quinn IP Law

(57) ABSTRACT

A footwear upper comprises a front section and a rear section. The front section is at least partially forward of the rear section and at least partially defines a foot-receiving cavity. The front section has a medial edge and a lateral edge partially defining a foot entry opening. A zipper system includes a medial slider movable along the medial edge of the front section to zip the rear section to the medial edge, a medial zipper pull engaged with the medial slider, a lateral slider movable along the lateral edge of the front section to zip the rear section to the lateral edge, and a lateral zipper pull engaged with the lateral slider. A tightening system includes a lace-receiving feature on the front section forward of the zipper system, and a lace extending through the lace-receiving feature, through the medial zipper pull, and through the lateral zipper pull.

20 Claims, 9 Drawing Sheets

(51) Int. Cl.

| | |
|---|---|
| ***A43B 23/02*** | (2006.01) |
| ***A43C 3/00*** | (2006.01) |
| ***A43B 3/00*** | (2006.01) |
| ***A43C 1/00*** | (2006.01) |
| ***A43C 11/00*** | (2006.01) |
| ***A43B 3/24*** | (2006.01) |
| ***A43B 7/20*** | (2006.01) |

(52) U.S. Cl.
CPC ..... *A43B 23/0245* (2013.01); *A43C 1/00* (2013.01); *A43C 3/00* (2013.01); *A43C 11/008* (2013.01); *A43C 11/12* (2013.01)

(58) Field of Classification Search
USPC ..... 36/50.1
See application file for complete search history.

(56) References Cited

U.S. PATENT DOCUMENTS 171,301 A 12/1875 McKee
417,460 A 12/1889 Wurtele
474,574 A 5/1892 Bruzon
503,588 A 8/1893 Elterich et al.
537,627 A 4/1895 Bixby et al.
558,937 A 4/1896 Edmonds
808,948 A 1/1906 Roberts
827,330 A 7/1906 Tillson
863,549 A 8/1907 Metz
955,337 A 4/1910 Lawlor
1,081,678 A 12/1913 Langerak
1,494,236 A 5/1924 Greathouse
1,585,049 A 5/1926 Skoglund
1,603,144 A 10/1926 Nichols
1,686,175 A 10/1928 Read
1,798,470 A * 3/1931 Janke ..... A43C 11/12 36/50.1
1,798,471 A * 3/1931 Janke ..... A43B 3/02 36/50.1
1,812,622 A 6/1931 Costello
2,069,752 A 2/1937 Dorr
2,252,315 A 8/1941 Doree
2,302,596 A * 11/1942 Bigio ..... A43B 3/24 36/101
2,357,980 A 9/1944 Spiro
2,450,250 A 9/1948 Napton
2,452,502 A 10/1948 Tarbox
2,452,649 A 11/1948 Graves
2,487,227 A 11/1949 Eberle
2,619,744 A 12/1952 Mattes
2,693,039 A 11/1954 Balut
2,736,110 A 2/1956 Hardimon
2,746,178 A 5/1956 Miller et al.
2,825,155 A 3/1958 Hines
2,920,402 A 1/1960 Minera
3,039,207 A 6/1962 Lincors
3,146,535 A 9/1964 Owings
3,192,651 A 7/1965 Smith
3,349,505 A 10/1967 Lopez
3,400,474 A 9/1968 Tendler
3,436,842 A 4/1969 Sachs
3,509,646 A * 5/1970 Vietas ..... A43B 5/16 36/115
3,681,860 A 8/1972 Bidegain
4,095,356 A 6/1978 Robran et al.
4,136,468 A 1/1979 Munschy
4,309,832 A 1/1982 Hunt
4,414,761 A 11/1983 Mahood
4,489,509 A 12/1984 Libit
4,507,879 A 4/1985 Dassler
4,559,724 A 12/1985 Norton
4,562,651 A 1/1986 Frederick et al.
4,573,457 A 3/1986 Parks
4,594,798 A 6/1986 Autry et al.
4,599,811 A 7/1986 Rousseau
4,615,126 A 10/1986 Mathews
4,628,622 A * 12/1986 McBarron ..... A43B 11/00 36/112
4,649,656 A 3/1987 Cox et al.
4,665,634 A 5/1987 Diaz
4,776,111 A 10/1988 Crowley
4,944,099 A 7/1990 Davis
4,959,914 A 10/1990 Hilgarth
4,972,613 A 11/1990 Loveder
5,054,216 A 10/1991 Lin
5,090,140 A 2/1992 Sessa
5,127,170 A 7/1992 Messina
5,152,082 A 10/1992 Culpepper
5,181,331 A 1/1993 Berger
5,184,410 A 2/1993 Hamilton
5,222,313 A 6/1993 Dowdy et al.
5,279,051 A 1/1994 Whatley
5,282,327 A 2/1994 Ogle
5,341,583 A 8/1994 Hallenbeck
5,345,698 A 9/1994 Billet et al.
5,371,957 A 12/1994 Gaudio
5,467,537 A 11/1995 Aveni et al.
5,481,814 A 1/1996 Spencer
5,557,866 A 9/1996 Prengler
5,570,523 A 11/1996 Lin
5,682,687 A 11/1997 Arai
5,813,144 A 9/1998 Prengler
5,842,292 A 12/1998 Siesel
5,884,420 A 3/1999 Donnadieu
5,983,530 A 11/1999 Chou
5,997,027 A 12/1999 Jungkind
6,000,148 A 12/1999 Cretinon
6,189,239 B1 2/2001 Gasparovic et al.
6,290,559 B1 9/2001 Scott
6,298,582 B1 10/2001 Friton et al.
6,378,230 B1 4/2002 Rotem et al.
6,438,872 B1 8/2002 Chil et al.
6,557,271 B1 5/2003 Weaver, III
6,578,288 B2 6/2003 Bernstein
6,594,921 B2 7/2003 Laio et al.
6,643,954 B2 11/2003 Voswinkel
6,684,533 B1 2/2004 Su
6,718,658 B2 4/2004 Karasawa
6,817,116 B2 11/2004 Chil et al.
6,883,254 B2 4/2005 Miller et al.
6,925,732 B1 8/2005 Clarke
6,938,361 B2 9/2005 Su
6,957,504 B2 10/2005 Morris
6,964,119 B2 11/2005 Weaver, III
7,055,268 B2 6/2006 Ha
7,059,069 B2 6/2006 Raluy et al.
7,080,468 B2 7/2006 Miller et al.
7,101,604 B1 9/2006 Minges
7,103,994 B2 9/2006 Johnson
7,127,837 B2 10/2006 Ito
7,178,270 B2 2/2007 Hurd et al.
7,188,438 B1 3/2007 Bowen
7,225,563 B2 6/2007 Chen et al.
7,284,341 B2 10/2007 Moseley
7,287,294 B2 10/2007 Miller et al.
7,439,837 B2 10/2008 McDonald
7,448,148 B2 11/2008 Martinez et al.
7,472,495 B2 1/2009 Milbourn
7,526,881 B2 5/2009 Jones et al.
7,581,337 B2 9/2009 Miller et al.
7,607,242 B2 10/2009 Karandonis et al.
7,685,747 B1 3/2010 Gasparovic et al.
7,694,435 B1 4/2010 Kiser et al.
7,735,244 B1 6/2010 Ameche
7,793,438 B1 9/2010 Busse et al.
7,823,299 B1 11/2010 Brigham
7,900,377 B1 3/2011 Perenich
7,905,033 B1 3/2011 Perenich
7,913,422 B1 3/2011 Perenich
7,950,166 B1 5/2011 Perenich
7,975,403 B2 7/2011 Mosher
7,984,571 B2 7/2011 Pellegrini
8,006,410 B2 8/2011 Romboli et al.
8,020,317 B1 9/2011 Sokolowski

(56) References Cited

U.S. PATENT DOCUMENTS

| | | | |
|---|---|---|---|
| D648,512 | S | 11/2011 | Schlageter et al. |
| 8,065,819 | B2 | 11/2011 | Kaufman |
| 8,161,669 | B2 | 4/2012 | Keating |
| 8,171,657 | B1 | 5/2012 | Perenich |
| 8,215,030 | B2 | 7/2012 | Bowen et al. |
| 8,225,534 | B2 | 7/2012 | Mueller et al. |
| 8,225,535 | B2 | 7/2012 | Dillenbeck |
| 8,245,418 | B2 | 8/2012 | Paintin et al. |
| 8,245,421 | B2 | 8/2012 | Baudouin et al. |
| 8,256,146 | B2 | 9/2012 | Loverin |
| 8,365,443 | B2 | 2/2013 | Huynh |
| D680,719 | S | 4/2013 | Dardinski |
| 8,468,721 | B2 | 6/2013 | Sokolowski |
| 8,468,723 | B2 | 6/2013 | Malka-Harari |
| 8,499,474 | B2 | 8/2013 | Kaufman |
| 8,539,698 | B1 | 9/2013 | Woodruff |
| 8,549,774 | B2 | 10/2013 | Meschter et al. |
| 8,627,582 | B2 | 1/2014 | Perenich |
| 8,627,583 | B2 | 1/2014 | Perenich |
| 8,635,791 | B2 | 1/2014 | Baudouin et al. |
| 8,656,613 | B2 | 2/2014 | Stockbridge et al. |
| 8,677,656 | B2 | 3/2014 | Nishiwaki et al. |
| 8,745,893 | B2 | 6/2014 | Gavrieli et al. |
| 8,763,275 | B2 | 7/2014 | Shalom et al. |
| 8,769,845 | B2 | 7/2014 | Lin |
| 8,834,770 | B2 | 9/2014 | Nakano |
| 8,919,015 | B2 | 12/2014 | Holt et al. |
| 9,015,962 | B2 | 4/2015 | Boudreau et al. |
| 9,032,646 | B2 | 5/2015 | Perenich |
| 9,044,063 | B2 | 6/2015 | Loverin et al. |
| 9,061,096 | B2 | 6/2015 | Taylor et al. |
| 9,089,184 | B1 | 7/2015 | Kiser et al. |
| 9,095,188 | B2 | 8/2015 | Cavaliere |
| 9,119,436 | B1 | 9/2015 | Ardell et al. |
| 9,119,437 | B2 | 9/2015 | Weller et al. |
| 9,144,262 | B2 | 9/2015 | Ardell et al. |
| 9,173,451 | B2 | 11/2015 | Shim |
| 9,226,543 | B2 | 1/2016 | Campbell |
| 9,254,018 | B2 | 2/2016 | Bliss |
| 9,265,305 | B2 | 2/2016 | Hatfield et al. |
| 9,301,570 | B2 | 4/2016 | Hwang |
| 9,314,055 | B2 | 4/2016 | Moran |
| 9,314,067 | B2 | 4/2016 | Bock |
| 9,363,980 | B2 | 6/2016 | Lander |
| 9,392,844 | B1 | 7/2016 | Burrell |
| 9,398,785 | B2 | 7/2016 | Horacek |
| 9,398,786 | B2 | 7/2016 | Gavrieli et al. |
| 9,414,640 | B2 | 8/2016 | Nichols |
| 9,433,256 | B2 | 9/2016 | Callahan et al. |
| 9,445,644 | B2 | 9/2016 | Cressman et al. |
| 9,474,330 | B2 | 10/2016 | Panian et al. |
| 9,480,299 | B2 | 11/2016 | Dinndorf et al. |
| 9,675,132 | B2 | 6/2017 | Marshall |
| 9,820,527 | B2 | 11/2017 | Pratt et al. |
| 9,839,261 | B2 | 12/2017 | Hatfield et al. |
| 9,854,875 | B2 | 1/2018 | Hatfield et al. |
| 9,877,542 | B2 | 1/2018 | Pratt |
| 9,949,533 | B2 | 4/2018 | Feinstein |
| 10,159,310 | B2 | 12/2018 | Sullivan |
| 2002/0144434 | A1 | 10/2002 | Farys et al. |
| 2002/0174568 | A1 | 11/2002 | Neiley |
| 2003/0200680 | A1 | 10/2003 | Chang |
| 2004/0111921 | A1 | 6/2004 | Lenormand |
| 2005/0039348 | A1 | 2/2005 | Raluy et al. |
| 2005/0060913 | A1 | 3/2005 | Chil et al. |
| 2005/0066548 | A1 | 3/2005 | Chil et al. |
| 2007/0011917 | A1 | 1/2007 | Hayes |
| 2007/0039208 | A1 | 2/2007 | Bove et al. |
| 2007/0074425 | A1 | 4/2007 | Leong |
| 2007/0186441 | A1 | 8/2007 | Chen |
| 2007/0199211 | A1 | 8/2007 | Campbell |
| 2007/0199213 | A1 | 8/2007 | Campbell et al. |
| 2007/0209234 | A1 | 9/2007 | Chou |
| 2008/0000106 | A1 | 1/2008 | Culpepper |
| 2008/0086911 | A1 | 4/2008 | Labbe |
| 2008/0141562 | A1 | 6/2008 | Peveto |
| 2008/0235987 | A1* | 10/2008 | Kaufman ..... A43B 3/24 36/50.1 |
| 2008/0307673 | A1 | 12/2008 | Johnson |
| 2009/0025260 | A1 | 1/2009 | Nakano |
| 2010/0319216 | A1 | 12/2010 | Grenzke et al. |
| 2011/0016751 | A1 | 1/2011 | Somerville |
| 2011/0146106 | A1 | 6/2011 | Kaufman |
| 2011/0247238 | A1 | 10/2011 | Chestnut |
| 2012/0079746 | A1* | 4/2012 | Ferreira ..... A43B 11/00 36/105 |
| 2012/0204450 | A1 | 8/2012 | Girbaud |
| 2012/0317839 | A1 | 12/2012 | Pratt |
| 2013/0185959 | A1 | 7/2013 | Coleman |
| 2013/0219747 | A1 | 8/2013 | Lederer |
| 2014/0000131 | A1 | 1/2014 | Meschter et al. |
| 2014/0013624 | A1 | 1/2014 | Stockbridge et al. |
| 2014/0096415 | A1 | 4/2014 | Long |
| 2014/0115925 | A1 | 5/2014 | Hurd et al. |
| 2014/0250723 | A1 | 9/2014 | Kohatsu |
| 2014/0298687 | A1 | 10/2014 | Flinterman et al. |
| 2014/0305005 | A1 | 10/2014 | Yeh |
| 2014/0310992 | A1 | 10/2014 | Shalom et al. |
| 2014/0360049 | A1 | 12/2014 | Panian et al. |
| 2015/0020416 | A1 | 1/2015 | Wiens |
| 2015/0047223 | A1 | 2/2015 | Flinterman et al. |
| 2015/0047227 | A1 | 2/2015 | Fallon et al. |
| 2015/0096197 | A1 | 4/2015 | Salinas |
| 2015/0113834 | A1 | 4/2015 | Dojan et al. |
| 2015/0143720 | A1 | 5/2015 | Avar |
| 2015/0196095 | A1 | 7/2015 | Chapman |
| 2015/0216252 | A1 | 8/2015 | Wiens |
| 2015/0289595 | A1 | 10/2015 | Rushbrook et al. |
| 2015/0305432 | A1 | 10/2015 | Wiens |
| 2015/0305442 | A1 | 10/2015 | Ravindran |
| 2015/0374065 | A1 | 12/2015 | DiFrancisco |
| 2016/0128429 | A1 | 5/2016 | Hatfield et al. |
| 2016/0166006 | A1 | 6/2016 | DiFrancisco |
| 2016/0242493 | A1 | 8/2016 | Stillwagon |
| 2016/0302530 | A1 | 10/2016 | Smith et al. |
| 2016/0374427 | A1 | 12/2016 | Zahabian |
| 2017/0042290 | A1 | 2/2017 | Hatfield et al. |
| 2017/0049190 | A1 | 2/2017 | Maussen |
| 2017/0099906 | A1 | 4/2017 | Figueroa |
| 2017/0360143 | A1 | 12/2017 | Pratt et al. |
| 2018/0110287 | A1 | 4/2018 | Hopkins et al. |
| 2018/0110288 | A1 | 4/2018 | Hatfield et al. |
| 2018/0110289 | A1 | 4/2018 | Owings et al. |
| 2018/0110292 | A1 | 4/2018 | Beers et al. |
| 2018/0206588 | A1 | 7/2018 | Pratt et al. |
| 2018/0213882 | A1 | 8/2018 | Morse |
| 2018/0213890 | A1 | 8/2018 | Innocente |
| 2018/0235314 | A1 | 8/2018 | Farage |
| 2018/0263332 | A1 | 9/2018 | Bruno |
| 2018/0338566 | A1* | 11/2018 | Hatfield ..... A43B 11/00 |
| 2019/0223555 | A1* | 7/2019 | Iannuzzi ..... A43B 1/0027 |

FOREIGN PATENT DOCUMENTS

| | | | |
|---|---|---|---|
| CN | 2052208 | U | 2/1990 |
| CN | 2112959 | U | 8/1992 |
| CN | 2161101 | Y | 4/1994 |
| CN | 2262929 | Y | 9/1997 |
| CN | 2268406 | Y | 11/1997 |
| CN | 2275814 | Y | 3/1998 |
| CN | 2281094 | Y | 5/1998 |
| CN | 2384464 | Y | 6/2000 |
| CN | 2438353 | Y | 7/2001 |
| CN | 2456500 | Y | 10/2001 |
| CN | 2482829 | Y | 3/2002 |
| CN | 1403041 | A | 3/2003 |
| CN | 1565297 | A | 1/2005 |
| CN | 2712118 | Y | 7/2005 |
| CN | 1720835 | A | 1/2006 |
| CN | 2783792 | Y | 5/2006 |
| CN | 2819852 | Y | 9/2006 |
| CN | 1278639 | C | 10/2006 |
| CN | 1943463 | A | 4/2007 |
| CN | 2901950 | Y | 5/2007 |

(56) References Cited

FOREIGN PATENT DOCUMENTS

| | | | |
|---|---|---|---|
| CN | 201005111 | Y | 1/2008 |
| CN | 201157014 | Y | 12/2008 |
| CN | 201167619 | Y | 12/2008 |
| CN | 101485505 | A | 7/2009 |
| CN | 101518380 | A | 9/2009 |
| CN | 201426430 | Y | 3/2010 |
| CN | 201504620 | U | 6/2010 |
| CN | 101500446 | B | 1/2011 |
| CN | 201743039 | U | 2/2011 |
| CN | 101986920 | A | 3/2011 |
| CN | 201831038 | U | 5/2011 |
| CN | 102159288 | A | 8/2011 |
| CN | 201967803 | U | 9/2011 |
| CN | 102256673 | A | 11/2011 |
| CN | 202211219 | U | 5/2012 |
| CN | 101991227 | B | 8/2012 |
| CN | 202819794 | U | 3/2013 |
| CN | 203121188 | U | 8/2013 |
| CN | 203137220 | U | 8/2013 |
| CN | 203841187 | U | 9/2014 |
| CN | 203884822 | U | 10/2014 |
| CN | 203913577 | U | 11/2014 |
| CN | 204070772 | U | 1/2015 |
| CN | 104394729 | A | 3/2015 |
| CN | 102595952 | B | 4/2015 |
| CN | 205040743 | U | 2/2016 |
| CN | 105876979 | A | 8/2016 |
| CN | 205568021 | U | 9/2016 |
| CN | 205658453 | U | 10/2016 |
| CN | 205671573 | U | 11/2016 |
| CN | 205795015 | U | 12/2016 |
| CN | 206025369 | U | 3/2017 |
| CN | 107692396 | A | 2/2018 |
| CN | 107921318 | A | 4/2018 |
| CN | 207544444 | U | 6/2018 |
| CN | 207949063 | U | 10/2018 |
| DE | 3310988 | A1 | 9/1984 |
| DE | 19534249 | A1 | 3/1997 |
| DE | 19611797 | A1 | 10/1997 |
| DE | 29809404 | U1 | 8/1998 |
| DE | 10247163 | A1 | 4/2004 |
| DE | 102004005288 | A1 | 8/2005 |
| DE | 102009023689 | A1 | 12/2010 |
| DE | 102013200701 | A1 | 7/2013 |
| DE | 202016001813 | U1 | 6/2017 |
| EP | 0570621 | A1 | 11/1993 |
| EP | 0548116 | B1 | 12/1994 |
| EP | 1059044 | A1 | 12/2000 |
| EP | 1593315 | B1 | 5/2008 |
| EP | 1952715 | A1 | 8/2008 |
| EP | 2173208 | B1 | 12/2010 |
| EP | 2277402 | A2 | 1/2011 |
| EP | 2490565 | A1 | 8/2012 |
| EP | 2036449 | B1 | 4/2013 |
| EP | 2818068 | A1 | 12/2014 |
| EP | 2848141 | A1 | 3/2015 |
| EP | 2937007 | A1 | 10/2015 |
| EP | 3167742 | A1 | 5/2017 |
| FR | 2994800 | A1 | 3/2014 |
| GB | 1154145 | A | 6/1969 |
| GB | 1358470 | A | 7/1974 |
| GB | 2517399 | A | 2/2015 |
| GB | 2533809 | A | 7/2016 |
| JP | H0181910 | U | 6/1989 |
| JP | 2001149394 | A | 6/2001 |
| JP | 2004236860 | A | 8/2004 |
| JP | 2006055571 | A | 3/2006 |
| JP | 2008206629 | A | 9/2008 |
| KR | 20090130804 | A | 12/2009 |
| KR | 20130119566 | A | 11/2013 |
| NL | 1020208 | C1 | 9/2003 |
| TW | 585748 | B | 5/2004 |
| TW | M275736 | U | 9/2005 |
| TW | 200930315 | A | 7/2009 |
| TW | 201130440 | A | 9/2011 |
| TW | M449484 | U | 4/2013 |
| TW | M469778 | U | 1/2014 |
| TW | I581730 | B | 5/2017 |
| WO | 8808678 | A1 | 11/1988 |
| WO | 9737556 | A1 | 10/1997 |
| WO | 03039283 | A1 | 3/2003 |
| WO | 2005070246 | A2 | 8/2005 |
| WO | 2006084185 | A1 | 8/2006 |
| WO | 2007024875 | A2 | 3/2007 |
| WO | 2007080205 | A1 | 7/2007 |
| WO | 2008115743 | A1 | 9/2008 |
| WO | 2008152414 | A1 | 12/2008 |
| WO | 2009154350 | A1 | 12/2009 |
| WO | 2010048203 | A1 | 4/2010 |
| WO | 2010059716 | A2 | 5/2010 |
| WO | 2010114993 | A1 | 10/2010 |
| WO | 2011004946 | A1 | 1/2011 |
| WO | 2011140584 | A1 | 11/2011 |
| WO | 2012044974 | A1 | 4/2012 |
| WO | 2012168956 | A1 | 12/2012 |
| WO | 2013039385 | A1 | 3/2013 |
| WO | 2013187288 | A1 | 12/2013 |
| WO | 2014033396 | A1 | 3/2014 |
| WO | 2014038937 | A1 | 3/2014 |
| WO | 2014140443 | A1 | 9/2014 |
| WO | 2015002521 | A1 | 1/2015 |
| WO | 2015198460 | A1 | 12/2015 |
| WO | 2016005696 | A1 | 1/2016 |
| WO | 2016015161 | A1 | 2/2016 |
| WO | 2018092023 | A1 | 5/2018 |
| WO | 2018193276 | A1 | 10/2018 |

OTHER PUBLICATIONS

U.S. Appl. No. 61/260,621, filed Nov. 12, 2009.

U.S. Appl. No. 62/326,650, filed Apr. 22, 2016.

U.S. Appl. No. 62/368,497, filed Jul. 29, 2016.

KIZIK Design, KIZIK® Shoes Launch Footwear Revolution with Patented Handsfree Technology, https://www.prnewswire.com/news-releases/kizik-shoes-launch-footwear-revolution-with-patented-handsfree-technology-300594838.html, Feb. 7, 2018.

U.S. Appl. No. 62/486,311, filed Apr. 17, 2017.

Nike Ease Challenge Winner Announced, Nike News, Apr. 25, 2017, https://news.nike.com/news/nike-ease-challenge-winner-announced (accessed May 2, 2018).

* cited by examiner

FOOTWEAR UPPER WITH LACE-ENGAGED ZIPPER SYSTEM

CROSS-REFERENCE TO RELATED APPLICATIONS

This application claims the benefit of priority to U.S. Provisional Application No. 62/510,043 filed May 23, 2017, which is hereby incorporated by reference in its entirety.

TECHNICAL FIELD

The present teachings relate to an upper for an article of footwear having a rear section securable to a front section with a zipper system.

BACKGROUND

Traditionally, placing footwear on a foot often requires the use of one or both hands to stretch the ankle opening of a footwear upper, and hold the rear portion during foot insertion. The fit of the upper is then adjusted following foot insertion, such as by tying laces.

DESCRIPTION

Figure 1:
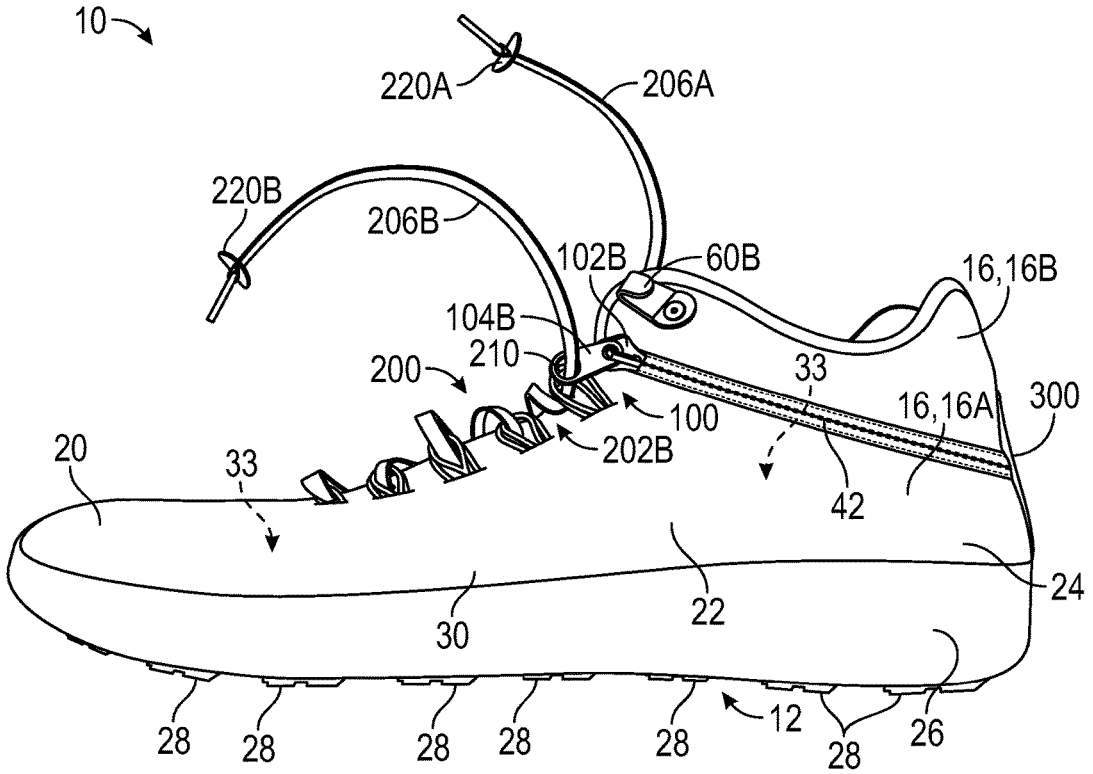
FIG. 1 is a schematic lateral side view of an article of footwear with a rear section of an upper in a use position and with a lace untied.

A footwear upper utilizes a lace-engaged zipper system to allow ease of foot entry and adjustment and securement of the upper on the foot. The footwear upper comprises a front section and a rear section. The front section is at least partially forward of the rear section and at least partially defines a foot-receiving cavity. In one or more embodiments, the front section is configured as a mule, as it partially establishes a heel region of the footwear upper, and the rear section is secured to the front section at the heel region between the medial edge and the lateral edge of the front section.

The front section has a medial edge and a lateral edge that together define a foot entry opening of the foot-receiving cavity. The footwear upper has a zipper system that includes a medial slider, a medial zipper pull, a lateral slider, and a lateral zipper pull. The medial slider is movable along the medial edge of the front section to selectively zip the rear section to the medial edge of the front section. The medial zipper pull is engaged with the medial slider. The lateral slider is movable along the lateral edge of the front section to selectively zip the rear section to the lateral edge of the front section. The lateral zipper pull is engaged with the lateral slider. The footwear upper also has a tightening system that includes a lace-receiving feature on the front section forward of the zipper system, and a lace extending through the lace-receiving feature, through the medial zipper pull, and through the lateral zipper pull.

In one or more embodiments, the medial zipper pull, the lateral zipper pull, and the lace-receiving feature are disposed such that a medially-outward force on the lace outward of the medial zipper pull, and a simultaneous laterally-outward force on the lace outward of the lateral zipper pull move the medial slider and the lateral slider forward along the medial edge and the lateral edge, respectively, moving the rear section from an access position to a use position. The rear section further defines the foot-receiving cavity in the use position.

Additionally, the lace-receiving feature may be disposed such that the lace tightens the front section via the medially-outward force and the simultaneous laterally-outward force. In one or more embodiments, the lace-receiving feature is one of a first series of lace-receiving features on the medial side of the front section and a second series of lace-receiving features on the lateral side of the front section, and the lace extends through the first series of lace-receiving features and the second series of lace-receiving features and spans a gap therebetween.

In one or more embodiments, the medial edge and the lateral edge of the front section slope upwardly in a forward direction (i.e., from a heel region of the footwear upper to a midfoot region of the footwear upper). The upward slope helps enable the large, easy to access ankle opening, permitting foot entry from the rear. In one or more embodiments, the rear section has a collar portion that defines an ankle opening of the foot-receiving cavity when the rear section is zipped to the front section.

In one or more embodiments, the footwear upper may further comprise at least one lace hook secured to the rear section. Both the lateral side and the medial side of the rear section may have a lace hook. For example, the at least one lace hook may include a medial lace hook and a lateral lace hook. The medial lace hook may be secured to the rear section on the medial side and disposed above the medial zipper pull when the rear section zipped to the front section. The lateral lace hook may be secured to the rear section on the lateral side and disposed above the lateral zipper pull when the rear section is zipped to the front section. In such an embodiment, a medial portion of the lace may be engaged with the medial lace hook, a lateral portion of the lace may be engaged with the lateral lace hook, and the medial portion may be tied to the lateral portion between the medial lace hook and the lateral lace hook when the lace is in a tied state with the rear section zipped to the front section.

To prevent the lace from passing completely out of the zipper pulls, the footwear upper may further comprise a medial lace anchor and a lateral lace anchor. The medial lace anchor may be fixed to a medial portion of the lace outward of the medial zipper pull, and the medial zipper pull may define an aperture through which the lace extends. The medial lace anchor is larger than the aperture of the medial zipper pull so that it cannot pass through the aperture. The lateral lace anchor may be fixed to a lateral portion of the lace outward of the lateral zipper pull. The lateral zipper pull may define an aperture through which the lace extends, and the lateral lace anchor may be larger than the aperture of the lateral zipper pull.

In one or more embodiments, the rear section may be biased to the access position. For example, the footwear upper may further comprise a biasing member that is secured to the rear section and applies a biasing force urging the rear section to an unzipped position when the rear section is zipped to the front section. The rear portion of the front section may define a through-hole, and the biasing member may extend through the through-hole and be secured to at least one of the front section or a sole structure secured to the front section. The biasing member may lay against an exterior surface of the rear section when the rear section is zipped to the front section.

To return the footwear upper to the unzipped, access position, an outward force may be applied to a forward medial end of the rear section remote from the medial zipper pull to move the medial slider rearward along the medial edge, and an outward force may be applied to a forward lateral end of the rear section remote from the lateral zipper pull to move the lateral slider rearward along the lateral edge. The outward forces to unzip the rear section may or may not be simultaneously applied.

An article of footwear comprises a sole structure, and a footwear upper that has a mule section secured to the sole structure, and an ankle support section hinged to a heel region of the mule section. The mule section has a medial edge that slopes upwardly from the heel region in a forward direction of the sole structure, and a lateral edge that slopes upwardly from the heel region in the forward direction of the sole structure. The article of footwear includes a zipper system that has lower teeth extending along a medial edge and a lateral edge of the mule section, and upper teeth extending along a proximal edge of the ankle support section. The zipper system includes a medial slider engaged with the lower teeth and the upper teeth on the medial side, a medial zipper pull engaged with the medial slider, a lateral slider engaged with the lower teeth and the upper teeth on the lateral side, and a lateral zipper pull engaged with the lateral slider on the lateral side. The article of footwear includes a tightening system that has a lace-receiving feature on the mule section forward of the zipper system, and a lace that extends through the lace-receiving feature, through the medial zipper pull, and through the lateral zipper pull. Outward forces applied to segments of the lace outward of the medial zipper pull and the lateral zipper pull move the medial slider and the lateral slider forward along the lower teeth, zipping the ankle support section to the mule section.

In one or more embodiments, the ankle support section pivots at the heel region between an access position in which the ankle support section is rearward of the heel region and is unzipped from the mule section, and a use position in which the ankle support section is zipped to the mule section.

In one or more embodiments, the article of footwear further comprises a medial lace hook secured to the ankle support section on the medial side and disposed above the medial zipper pull when the ankle support section is zipped to the mule section, and a lateral lace hook secured to the ankle support section on the lateral side and disposed above the lateral zipper pull when the ankle support section is zipped to the mule section. The lace hooks enable the ankle support section to be further secured to the mule section in the zipped position when the lace is engaged with the lace hooks and tied.

In one or more embodiments, in order to remove the article of footwear, an outward force applied to a forward medial end of the ankle support section and remote from the medial zipper pull moves the medial slider rearward along the medial edge, and an outward force applied to a forward lateral end of the ankle support section and remote from the lateral zipper pull moves the lateral slider rearward along the lateral edge.

In one or more embodiments, the article of footwear further comprises an elastic biasing member secured to a rear portion of the ankle support section and anchored to one of the sole structure or the mule section. The elastic biasing member is tensioned when the ankle support section is zipped to the mule section, and applies a biasing force urging the ankle support section to an unzipped position. The elastic biasing member thus enables the return of the ankle support section to the unzipped position when removal of the article of footwear is desired.

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, FIGS. 1-13 show an embodiment of an article of footwear 10. An article of footwear may also be referred to as footwear or as a footwear article of manufacture. An "article of footwear", a "footwear article of manufacture", and "footwear" have an identical meaning, and as used herein, may refer to one or more components configured to be assembled as part of a multi-component article of footwear, or may refer to an assembled, multi-component article of footwear. Stated differently, an "article of footwear" may refer to a discrete footwear component (such as a midsole, or an upper component), or a partially or entirely assembled article of footwear (for example, including both the midsole and the upper component assembled to one another). An article of footwear, a footwear article of manufacture, and footwear may be considered to be both a machine and a manufacture.

Figure 6:
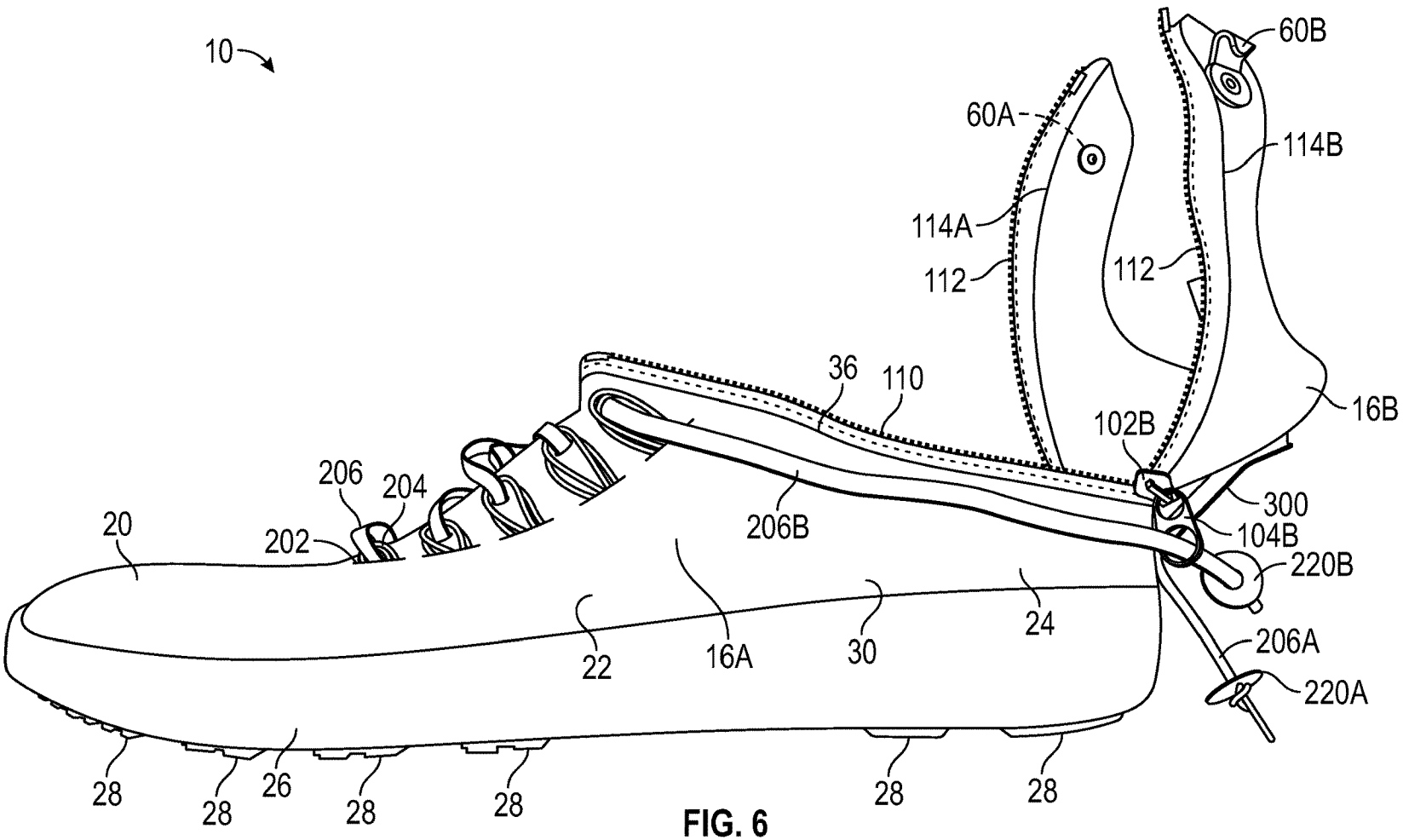
FIG. 6 is a schematic lateral side view of the article of footwear of FIG. 1 with the rear section of an upper in an access position and with the lace untied.
Figure 7:
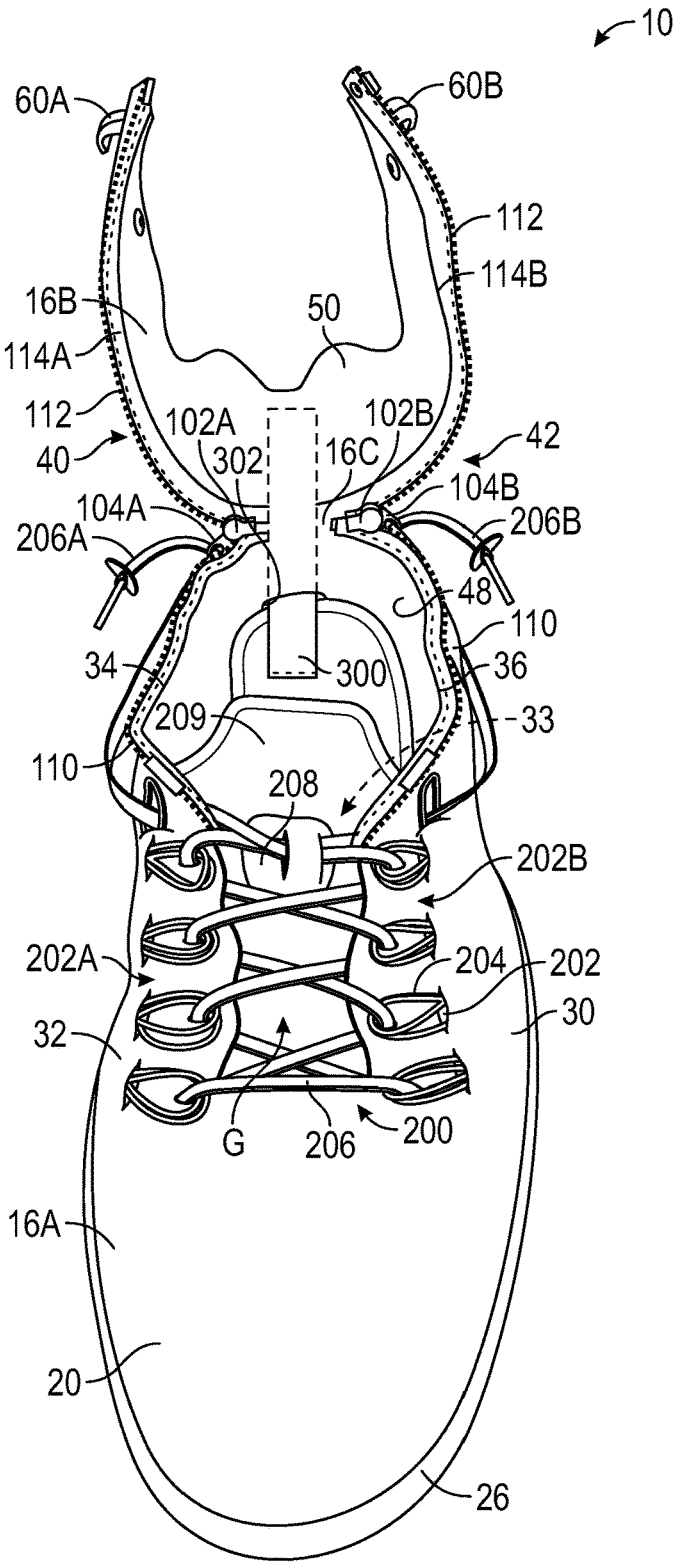
FIG. 7 is a schematic perspective front view of the article of footwear of FIG. 1 with the rear section of the upper in the access position and with the lace untied.
Figure 8:
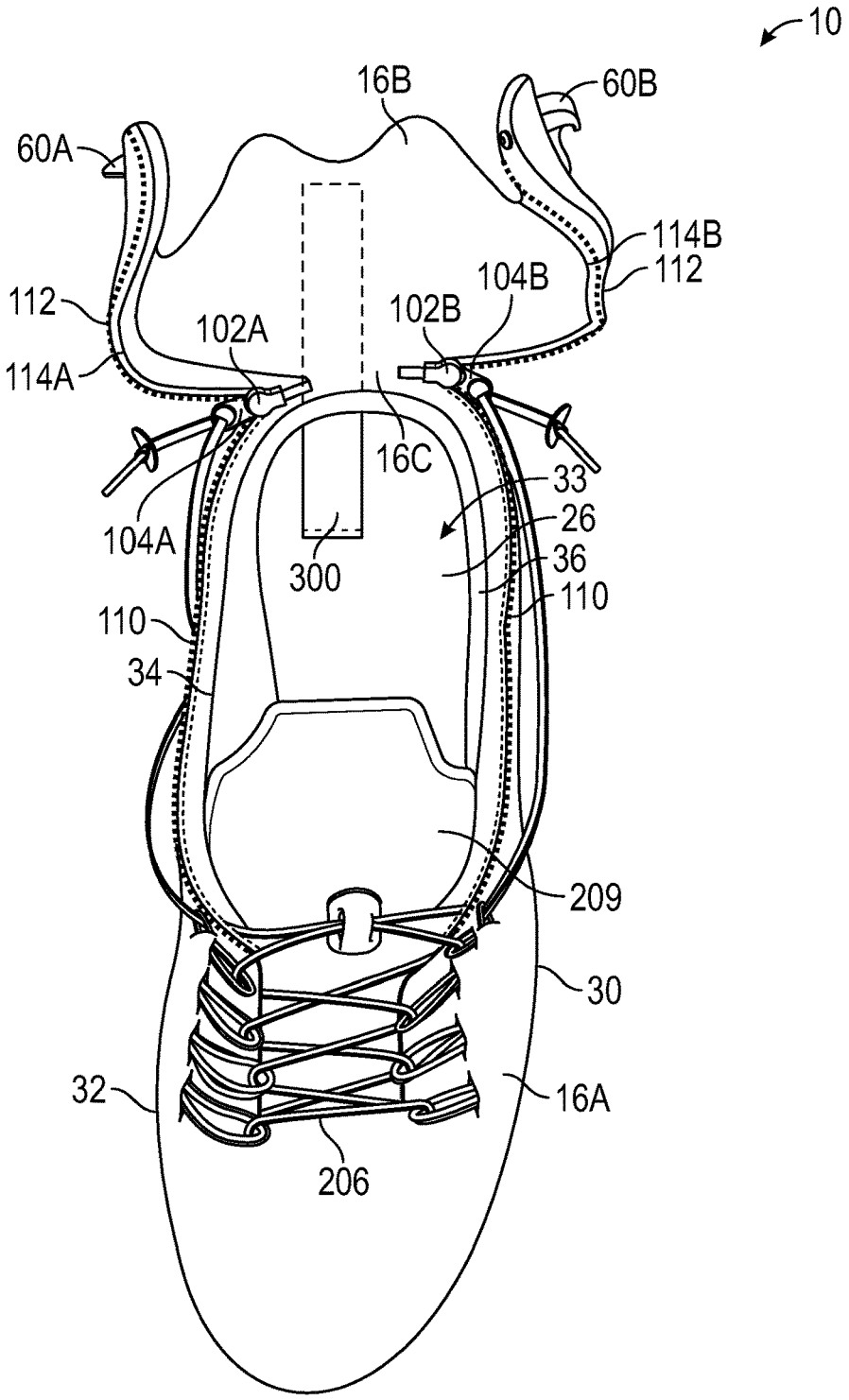
FIG. 8 is a schematic plan view of the article of footwear of FIG. 1 with the rear section of the upper in the access position and with the lace untied.
Figure 9:
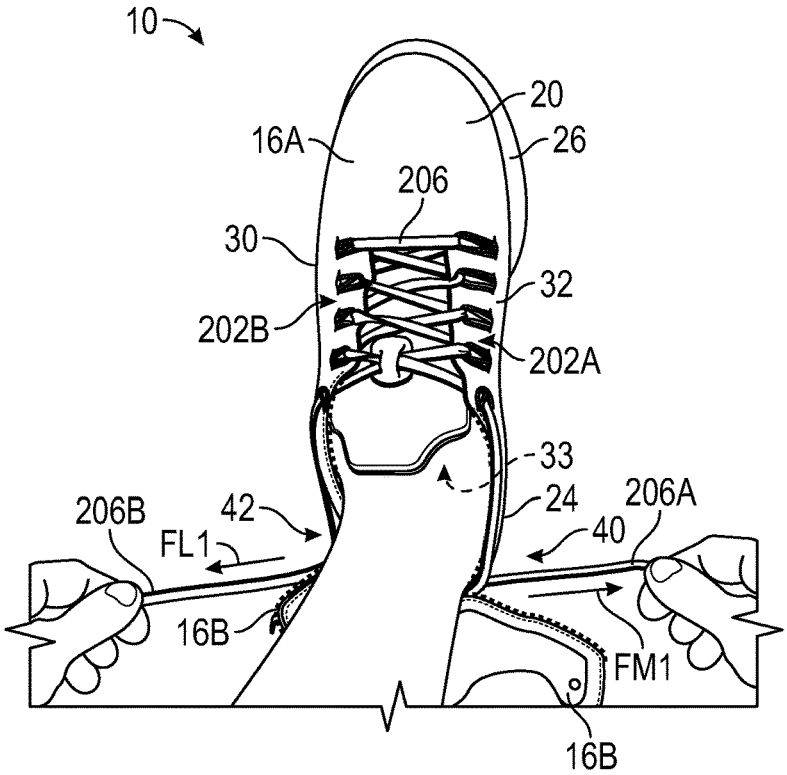
FIG. 9 is a schematic fragmentary plan view of the article of footwear of FIG. 1, showing a foot in phantom received in the foot-receiving cavity and hands in phantom applying outward forces on the lace.
Figure 10:
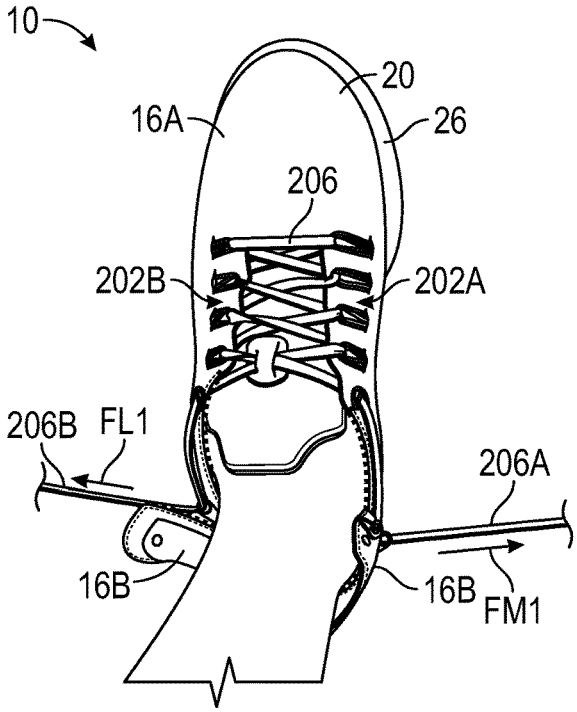
FIG. 10 is a schematic fragmentary plan view of the article of footwear of FIG. 9, showing the foot in phantom received in the foot-receiving cavity and zipper pulls moving forward to zip the rear section to the front section under continuing outward force on the lace.
Figure 11:
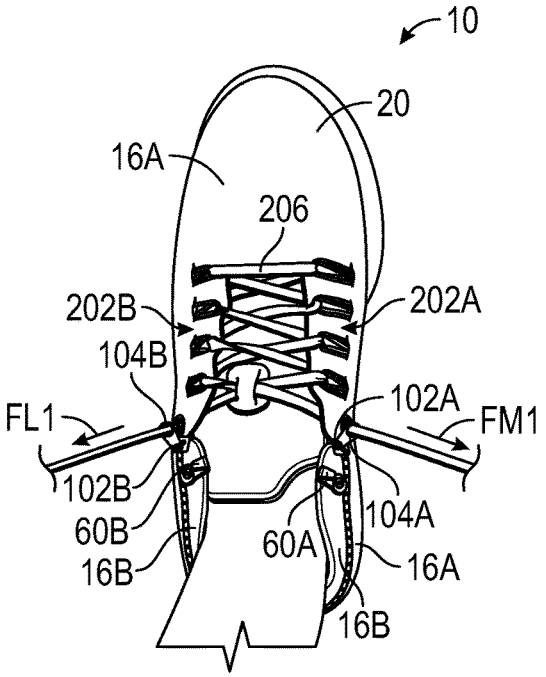
FIG. 11 is a schematic fragmentary plan view of the article of footwear of FIG. 9, showing the foot in phantom received in the foot-receiving cavity and zipper pulls moved to a forward-most position in which the rear section is zipped to the front section in the use position under continuing outward forces on the lace.
Figure 12:
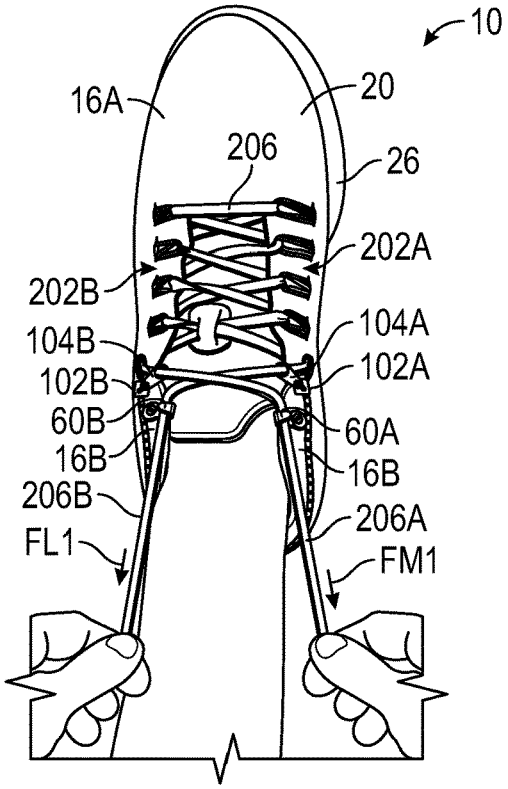
FIG. 12 is a schematic fragmentary plan view of the article of footwear of FIG. 9, showing the foot in phantom received in the foot-receiving cavity and hands shown in phantom guiding the lace around lace hooks secured to the rear section in the use position.
Figure 13:
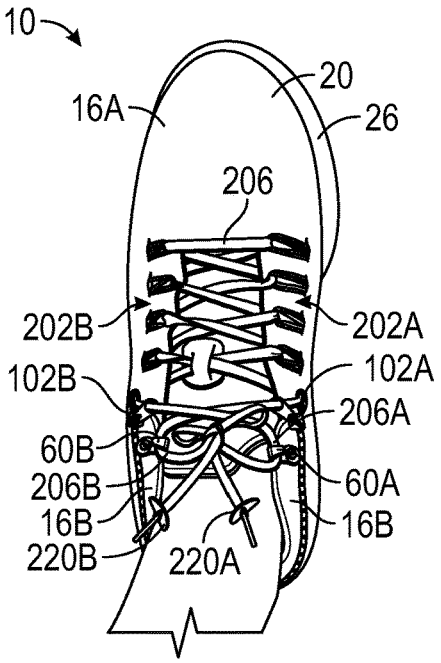
FIG. 13 is a schematic fragmentary plan view of the article of footwear of FIG. 9, showing the foot in phantom received in the foot-receiving cavity and the lace secured to the lace hooks and tied, with the rear section in the use position.

The article of footwear 10 includes a sole structure 12 and a footwear upper 16 that includes a front section 16A and a rear section 16B. The front section 16A is also referred to as a mule section, and the rear section 16B is also referred to as an ankle support section. As best shown in FIGS. 6-8, the rear section 16B (i.e. the ankle support section) is hinged to a heel region 24 of the front section 16A (i.e., the mule section). The sections 16A, 16B are configured to cooperate so that the rear section 16B moves from an access position (FIGS. 6-8, also referred to as a zipped position) to a use position (FIGS. 1-2, also referred to as an unzipped position), by zipping to the front section 16A when outward forces are applied to a lace 206. Stated differently, the rear section 16B pivots at the heel region 24 between an access position in which the rear section 16B is rearward of the heel region 24 and is unzipped from the front section 16A, and a use position in which the rear section 16B is zipped to the front section 16A. As used herein, movable "between" the access position and the use position means that the rear section 16B may be moved from one of the positions to the other of the positions. The use position is maintained via a zipper system 100 and a tightening system 200, as discussed herein, and is further secured manually following establishment of the use position.

As discussed herein, these and other features of the upper 16 and the article of footwear 10 enable the access position to afford easy foot entry into the article of footwear 10, for example, without requiring manually pulling the sides of the upper 16 apart to provide sufficient space for foot entry. Instead, the access position provides a large foot entry opening 48 (see FIG. 7) that angles upward from back to front (see FIG. 6) as described herein, allowing access from the rear. The foot entry opening 48 may be especially helpful for easing foot entry for those with relatively inflexible feet and/or ankles. For example, due to the sloped medial and lateral edges 34, 36 and the access position described herein, a foot held generally perpendicular to the lower leg (as positioned when standing) can enter the foot entry opening 48 with minimal need for dorsiflexion or plantar flexion during entry. The footwear 10 herein is depicted as a leisure shoe or an athletic shoe, but the present teachings also include an article of footwear that is a dress shoe, a work shoe, a sandal, a slipper, a boot, or any other category of footwear.

As indicated in FIG. 1, the footwear 10 may be divided into three general regions: a forefoot region 20, a midfoot region 22, and a heel region 24 which are also the forefoot region, the midfoot region, and the heel region, respectively, of the sole structure 12 and of the upper 16. The forefoot region 20 generally includes portions of the article of footwear 10 corresponding with the toes and the joints connecting the metatarsals with the phalanges. The midfoot region 22 generally includes portions of the article of footwear 10 corresponding with the arch area of the foot, and the heel region 24 corresponds with rear portions of the foot, including the calcaneus bone.

The sole structure 12 includes a midsole 26 and an outsole 28 secured to the midsole 26. The midsole 26 may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, the midsole 26 may incorporate fluid-filled chambers, plates, moderators, or other elements that further attenuate forces, enhance stability, or influence the motions of the foot. The midsole 26 is depicted as a single, one-piece midsole, but in other embodiments could be multiple components integrated as a unit. In some embodiments, the midsole 26 may be integrated with the outsole 28 as a unisole. The outsole 28 may be several discrete outsole components or may be one-piece, and may be formed from a wear-resistant rubber material that may be textured to impart traction and/or may include traction elements such as cleats secured to a bottom surface of the midsole 26.

Figure 3:
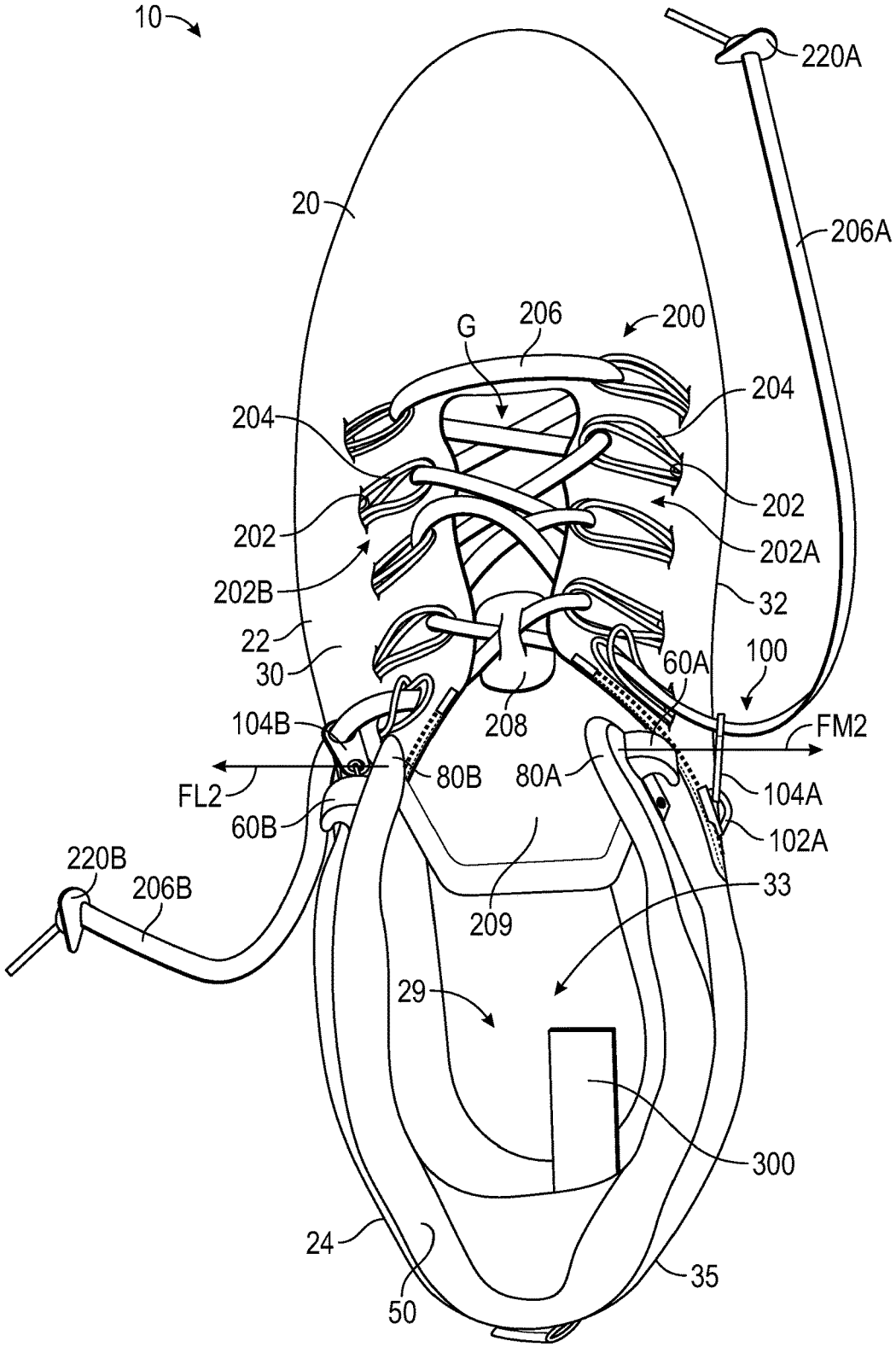
FIG. 3 is a schematic plan view of the article of footwear of FIG. 1 with the rear section of the upper in the use position and with the lace untied.
Figure 4:
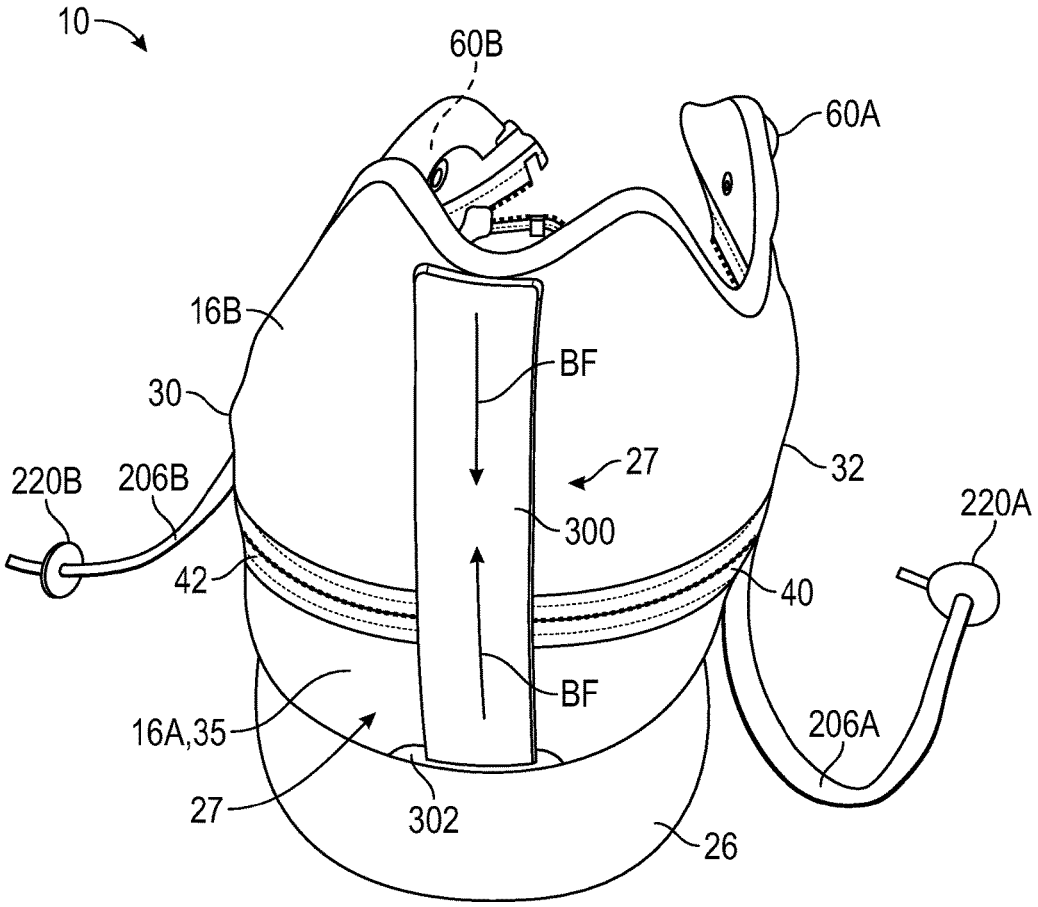
FIG. 4 is a schematic plan view of the article of footwear of FIG. 1 with the rear section of the upper in the use position and with the lace untied.

The sole structure 12 may include an insole (not shown) that would be positioned within a foot-receiving cavity 33 of the footwear 10, above a foot-facing surface 29 of the midsole 26 shown in FIG. 3, so that it is supported on the foot-facing surface 29. The foot-facing surface 29 of the midsole 26 may be covered by a strobel secured to the front section 16A, in which case the insole rests on the strobel in the use position, rather than directly on the foot-facing surface 29. In either case, the insole is supported on the midsole 26.

The footwear 10 has a lateral side 30 (FIG. 1) and a medial side 32 (FIG. 2) opposite from the lateral side 30. The lateral side 30 and the medial side 32 extend through each of forefoot region 20, the midfoot region 22, and the heel region 24 and correspond with opposite sides of the article of footwear 10. The forefoot region 20, the midfoot region 22, the heel region 24, the lateral side 30 and the medial side 32 are not intended to demarcate precise areas of footwear 10, but are instead intended to represent general areas of footwear 10 to aid in the discussion.

The footwear upper 16 may be a variety of materials, such as leather, textiles, polymers, cotton, foam, composites, etc. In one example, the footwear upper 16 may be a polymeric material capable of providing elasticity to the upper 16, and may be of braided construction, a knitted (e.g., warp-knitted) construction or a woven construction.

The front section 16A is fixed at least to the forefoot region 20 of the sole structure 12, and more specifically to the midsole 26 to partially define the foot-receiving cavity 33. In the embodiment shown, the front section 16A is configured as a mule and may be referred to as a mule section, as it extends from and is secured to the midsole 26 from the forefoot region 20 to the heel region 24, with a rear portion 35 extending around the heel region 24 from the lateral side 32 to the medial side 30. The foot-receiving cavity 33 receiving the forefoot region and midfoot region of a foot, and because the front section 16A is a mule configuration, it also establishes a portion of a foot-receiving cavity at the heel region 24.

Figure 2:
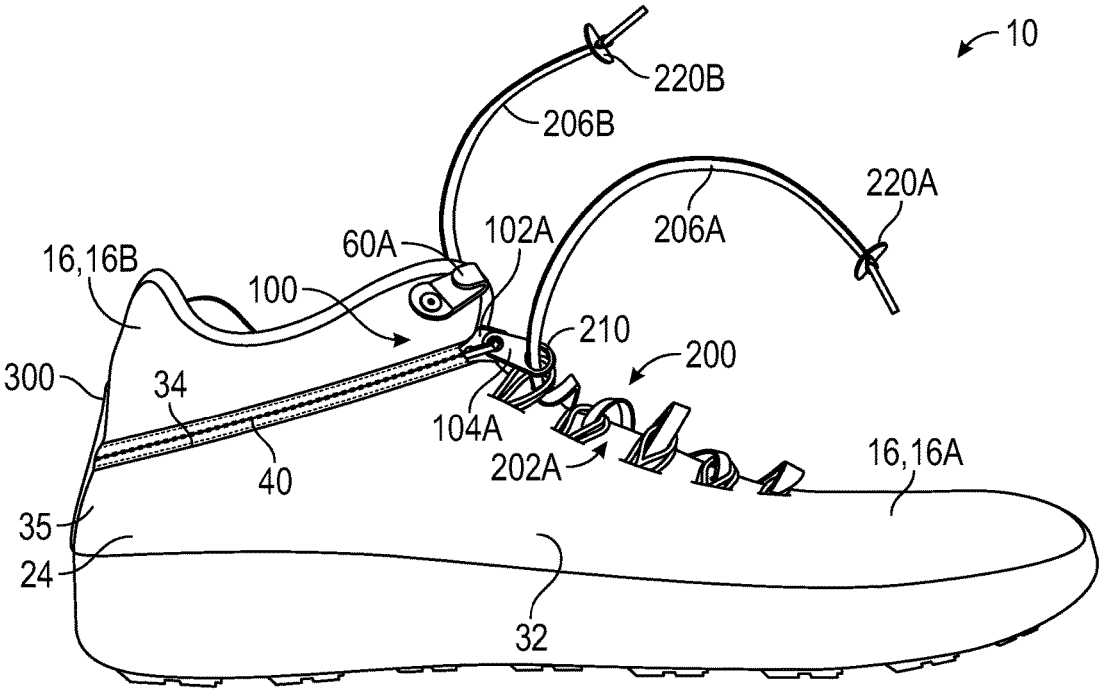
FIG. 2 is a schematic medial side view of the article of footwear of FIG. 1 with the rear section of the upper in the use position and with the lace untied.
Figure 5:
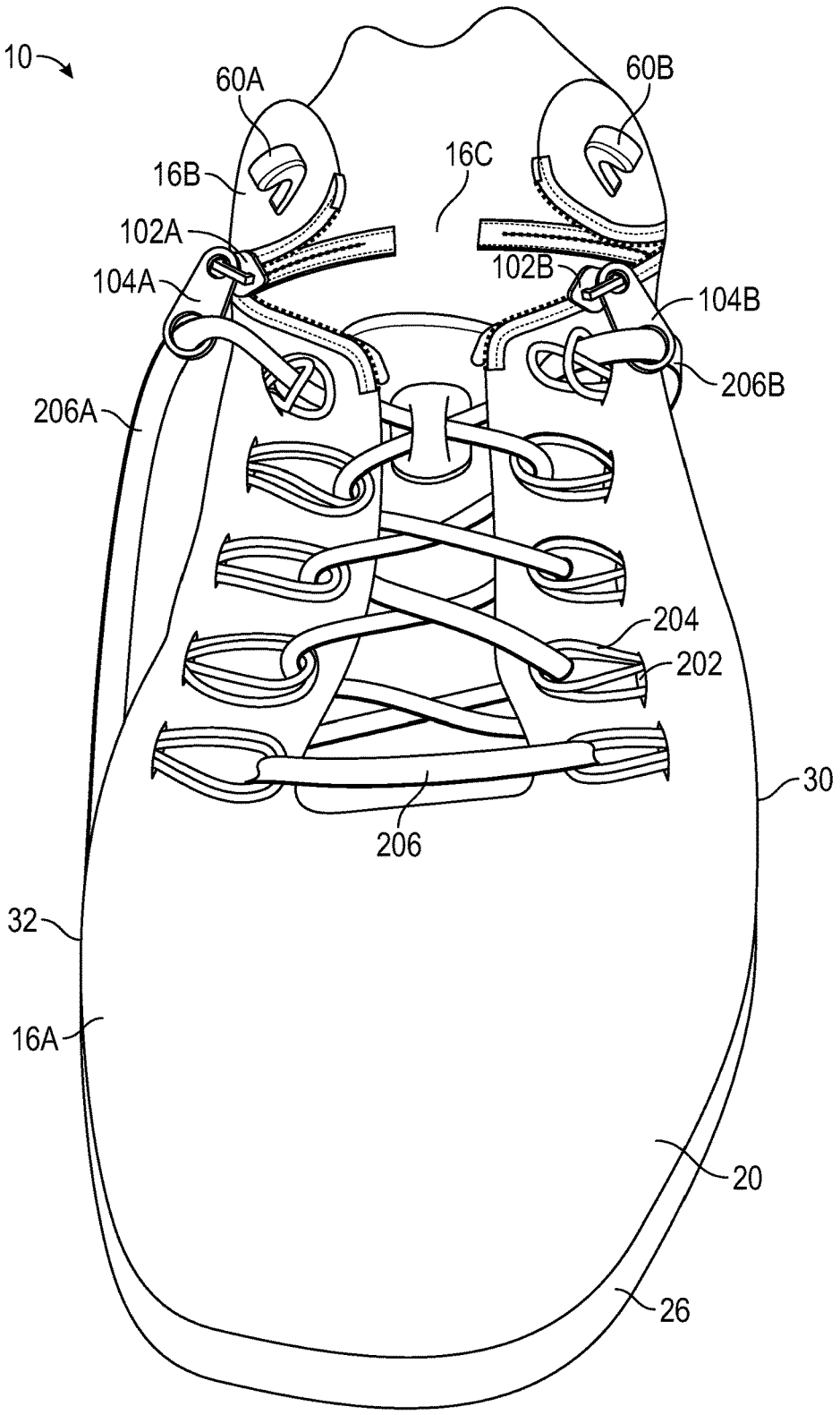
FIG. 5 is a schematic perspective front view of the article of footwear of FIG. 1 with the rear section of the upper in the use position and with the lace untied.

The rear section 16B is movable relative to the front section 16A between the access position of FIGS. 6-8 and the use position of FIGS. 1-5. The rear section 16B is at least partially rearward of the front section 16A both in the access position and in the use position. In the use position, the rear section 16B rests on the heel region 24 of the front section 16A as shown in FIGS. 1 and 2, but is still at least partially rearward of the forefoot and midfoot regions 20, 22 of the front section 16A. As indicated in FIGS. 5 and 7, the rear section 16B has a central portion 16C secured to the front section 16A at the heel region 24 and extending between the medial edge 34 and the lateral edge 36 of the front section 16A. The rear section 16B pivots in the heel region 24 at the central portion 16C between the access position in which the rear section 16B is unzipped from the front section 16A, and a use position in which the rear section 16B is zipped to the front section 16A.

The article of footwear 10 includes a zipper system 100 utilized to selectively move the rear section 16B between the access position and the use position. Additionally, as discussed herein, the tightening system 200, and most specifically the lace 206, is engaged with the zipper system 100 to enable simultaneous tightening of the front section 16A and movement of the rear section 16B to the use position. The zipper system 100 may be referred to as a lace-engaged zipper system.

As further discussed herein, medial and lateral zippers 40, 42 extend along the medial and lateral edges 34, 36 of the front section 16A and along proximal edges 114A, 114B of the rear section 16B, with the central portion 16C between the zippers 40, 42 acting as a hinge at which the rear section 16B pivots between the access position and the use position. The zippers 40, 42 may be configured as separate zippers, as shown, with a central section 16C formed by the rear section 16B between the zippers 40, 42, or the zippers 40, 42 could be a single, continuous zipper (i.e., upper and lower teeth on the lateral and medial sides are continuous, with the sliders 102A, 102B abutting each other in the access position. The medial edge 34 and the lateral edge 36 of the front section 16A partially define a foot entry opening 48 (indicated in FIG. 7) of the foot-receiving cavity 33. The rear section 16B has a collar portion 50 that defines the foot entry opening of the foot-receiving cavity 33 when the rear section 16B is in the use position.

As best shown in FIGS. 1, 2, and 6, the medial edge 34 slopes upwardly from the heel region 24 in a forward direction of the sole structure 12, and the lateral edge 36 slopes upwardly from the heel region 24 in the forward direction of the sole structure 12. The upward slope of the edges 34, 36 enables the rear portion 35 of the front section 16A to be relatively low, providing a wide foot entry opening 48 permitting foot entry from the rear, with the foot moving in a forward direction into the portion of the foot-receiving cavity 33 formed by the front section 16A with little or no plantar flexion or dorsiflexion of the foot required.

With reference to FIGS. 2 and 7, the medial zipper 40 of the zipper system 100 includes a medial slider 102A movable along the medial edge 34 of the front section 16A to selectively zip the rear section 16B to the medial edge 34 of the front section 16A. A medial zipper pull 104A is engaged with the medial slider 102A such that a force on the medial zipper pull 104A can cause the medial slider 102A to move along the medial edge 34, zipping or unzipping the front section 16A to the rear section 16B.

With reference to FIGS. 1 and 7, the lateral zipper 42 of the zipper system 100 includes a lateral slider 102B movable along the lateral edge 36 of the front section 16A to selectively zip the rear section 16B to the lateral edge 36 of the front section 16A. A lateral zipper pull 104B is engaged with the lateral slider 102B such that a force on the lateral zipper pull 104B can cause the lateral slider 102B to move along the lateral edge 34, zipping or unzipping the front section 16A to the rear section 16B.

With reference to FIGS. 6-8, each of the zippers 40, 42 has lower teeth 110 and upper teeth 112 configured to meshingly engage the lower teeth. The lower teeth 110 extend along both the medial edge 34 and the lateral edge 36 of the front section 16A, and the upper teeth 112 extend along both a medial proximal edge 114A and a lateral proximal edge 114B of the rear section 16B. The medial slider 102A is engaged with the lower teeth 110 and the upper teeth 112 on the medial side 32, and the lateral slider 102B is engaged with the lower teeth 110 and the upper teeth 112 on the lateral side 30.

As best shown in FIG. 3, the zipper system 100 interfaces with the tightening system 200. In addition to the lace 206, the tightening system 200 also includes lace-receiving features 202, 204 on the front section 16A forward of the zipper system 100. The lace-receiving features 202, 204 may be eyelets 202 and/or loops 204 or other features configured to retain the lace 206. In the embodiment shown, the lace-receiving features of the front section 16A include both eyelets 202 and loops 204. The lace-receiving features 202, 204 include a first series 202A of lace-receiving features 202, 204 on the medial side 32 of the front section 16A, and a second series 202B of lace-receiving features 202, 204 on the lateral side 30 of the front section 16A.

The tightening system 200 also includes the lace 206 that extends through the lace-receiving features 202, 204, through an aperture 210 of the medial zipper pull 104A, and through an aperture 210 of the lateral zipper pull 104B as shown in FIGS. 1 and 2. The lace 206 extends through the first series 202A of lace-receiving features and the second series 202B of lace-receiving features and spans a gap G therebetween. The front section 16A has a tongue 209 with a lace holder 208 on the tongue. The lace 206 extends through the lace holder 208 to further secure the lace 206 relative to the front section 16A.

Outward forces applied to segments 206A, 206B of the lace 206 outward of the medial zipper pull 104A and the lateral zipper pull 104B, respectively, move the medial slider 102A and the lateral slider 102B forward along the lower teeth 110, zipping the rear section 16B to the front section 16A. The rear section 16B thus moves from the access position of FIGS. 6-9 to the use position of FIGS. 1-5 and 11-13 when the rear section 16B is zipped to the lateral edge 36 and to the medial edge 34. The rear section 16B further defines the foot-receiving cavity 33 in the use position.

With reference to FIGS. 9-12, the medial zipper pull 104A, the lateral zipper pull 104B, and the series of lace-receiving features 202A, 202B are disposed such that a medially-outward force FM1 on the lace segment 206A outward of the medial zipper pull 102A, and a simultaneous laterally-outward force FL1 on the lace segment 206B outward of the lateral zipper pull 102B move the medial slider 102A and the lateral slider 102B forward along the medial edge 34 and the lateral edge 36, respectively. The lace 206 slides through the zipper pulls 104A, 104B, lengthening the segments 206A, 206B outward of the zipper pulls 104A, 104B, while simultaneously engaging the zipper pulls 104A, 104B by applying force on edges of the pulls 104A, 104B at the apertures 210 to move the zipper pulls 104A, 104B upward and forward along the sloped edges 34, 36. Manually pulling the lace segments 206A, 206B in this manner may be easier than gripping and pulling the smaller zipper pulls 104A, 104B. The medially-outward force FM1 and the laterally-outward force FL1 need only have a force component perpendicular to a longitudinal axis of the footwear 10 (i.e., transversely outward), and need not be directed entirely in a transversely outward direction.

The lace 206 may have lace anchors 220A, 220B that prevent the ends of the lace 206 from passing through the apertures 210 during wear and use. A medial lace anchor 220A is fixed to the medial lace segment 206A of the lace 206 outward of the medial zipper pull 104A. The medial zipper pull 104A defines an aperture 210 through which the lace 206 extends, and the medial lace anchor 220A is larger than the aperture 210 of the medial zipper pull 104A. A lateral lace anchor 220B is fixed to a lateral segment 206B of the lace 206 outward of the lateral zipper pull 104B. The lateral zipper pull 104B defines an aperture 210 through which the lace 206 extends, and the lateral lace anchor 220B is larger than the aperture 210 of the lateral zipper pull 104B.

Once the rear section 16B is in the use position, it can be further secured to the front section 16A via the lace 206 and at least one lace hook 60A, and/or 60B that is secured to the rear section 16B. The lace hooks 60A, 60B on the rear section 16B are used in conjunction with the tightening system 200 on the front section 16A to secure the rear section 16B to the front section 16A sufficiently to withstand the various forces exerted on the upper 16 during wear. For example, a medial lace hook 60A is secured to the rear section 16B on the medial side 32 and disposed above the medial zipper pull 104A when the rear section 16B is in the use position (i.e., zipped to the front section 16A). Similarly, a lateral lace hook 60B may be secured to the rear section 16B on the lateral side 30 and disposed above the lateral zipper pull 104B when the rear section 16B is in the use position. The lace segments 206A, 206B are looped partially around the lace hooks 60A, 60B (e.g., guided below, around, and then forward relative to the lace hooks 60A, 60B), and then tied together between the lace hooks 60A, 60B. A medial portion of the lace 206 (i.e., lace segment 206A) is engaged with the medial lace hook 60A, a lateral portion of the lace 206 (i.e., lace segment 206B) is engaged with the lateral lace hook 60B, and the lace segment 206A is tied to the lace segment 206B between the medial lace hook 60A and the lateral lace hook 60B when the lace 206 is in a tied state with the rear section 16B in the use position.

To remove the article of footwear 10, the rear section 16B is returned to the access position. First, the lace 206 is untied, and then the lace segments 206A, 206B are disengaged from (i.e., unlooped from around) the respective lace hooks 60A, 60B. An outward force FM2 (see FIG. 3) applied to a forward medial end 80A of the rear section 16B remote from the medial zipper pull 104A moves the medial slider 102A rearward along the medial edge 34, and an outward force FL2 applied to a forward lateral end 80B of the rear section 16B remote from the lateral zipper 104B pull moves the lateral slider 102B rearward along the lateral edge 36, until the zipper pulls 104A, 104B are at the positions shown in FIGS. 6 and 7. The rear section 16B can then be easily moved back to the access position such as by the force of the foot being withdrawn from the foot-receiving cavity 33, or, in the embodiment shown, automatically moved back from the access position when the zippers 40, 42 are unzipped due to the biasing force of a biasing member 300. For example, the article of footwear 10 comprises an elastic biasing member 300 secured to the rear portion 35 of the rear section 16B and anchored to the sole structure 12 (e.g., to midsole 26) or to the front section 16A.

The rear portion 35 of the front section 16A defines a through-hole 302. Stated differently, a through-hole 302 extends entirely through the front section 16A from an exterior surface 27 to an interior surface. The biasing member 300 extends through the through-hole 302 and is secured to the sole structure 12 inward of the rear section 16B. The biasing member 300 lays against the exterior surface 27 of the rear section 16B when the rear section 16B is in the use position. The length of the biasing member 300 is selected so that the biasing member 300 is tensioned (i.e., elastically stretched) when the rear section 16B is zipped to the front section 16A in the use position, and has more slack when the rear section 16B is in the access position. Accordingly, the biasing member 300 applies a biasing force BF urging the rear section 16B to the unzipped, access position.

Accordingly, a large ankle opening 48 is provided, and simply pulling laterally outward on the lace 206 zips the rear section 16B to the front section 16A while simultaneously tightening the front section 16A. Lace pulls 220A, 220B prevent the lace 206 from coming out of the zipper pulls 104A, 104B, and the biasing member 300 aids in returning the rear section 16B to the access position.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear" or "footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, unless stated otherwise, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of an article of footwear extends between a forefoot region and a heel region of the article of footwear. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of an article of footwear extends between a lateral side and a medial side of the article of footwear. The transverse direction or axis may also be referred to as a lateral direction or axis or a mediolateral direction or axis.

The term "vertical" refers to a direction generally perpendicular to both the lateral and longitudinal directions. For example, in cases where a sole structure is planted flat on a ground surface, the vertical direction may extend from the ground surface upward. It will be understood that each of these directional adjectives may be applied to individual components of a sole structure. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the article of footwear is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the article of footwear in an assembled article of footwear. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

The invention claimed is:

1. A footwear upper comprising:

a front section and a rear section; the front section at least partially forward of the rear section and at least partially defining a foot-receiving cavity; the front section having a medial edge and a lateral edge partially defining a foot entry opening of the foot-receiving cavity;

a zipper system including:

a medial slider movable along the medial edge of the front section to selectively zip the rear section to the medial edge of the front section;

a medial zipper pull engaged with the medial slider;

a lateral slider movable along the lateral edge of the front section to selectively zip the rear section to the lateral edge of the front section;

a lateral zipper pull engaged with the lateral slider;

a tightening system including:

a lace-receiving feature on the front section forward of the zipper system; and a lace extending through the lace-receiving feature, through the medial zipper pull, and through the lateral zipper pull.

2. The footwear upper of claim 1, wherein the medial zipper pull, the lateral zipper pull, and the lace-receiving feature are disposed such that a medially-outward force on the lace outward of the medial zipper pull, and a simultaneous laterally-outward force on the lace outward of the lateral zipper pull move the medial slider and the lateral slider forward along the medial edge and the lateral edge, respectively, moving the rear section from an access position to a use position, the rear section further defining the foot-receiving cavity in the use position.

3. The footwear upper of claim 2, wherein the lace-receiving feature is disposed such that the lace tightens the front section via the medially-outward force and the simultaneous laterally-outward force.

4. The footwear upper of claim 1, wherein the medial edge and the lateral edge of the front section slope upwardly from a heel region of the footwear upper to a midfoot region of the footwear upper.

5. The footwear upper of claim 1, wherein the rear section has a collar portion that defines an ankle opening of the foot-receiving cavity when the rear section is zipped to the front section.

6. The footwear upper of claim 1, further comprising:

at least one lace hook secured to the rear section.

7. The footwear upper of claim 6, wherein the at least one lace hook includes:

a medial lace hook secured to the rear section on a medial side of the rear section and disposed above the medial zipper pull when the rear section zipped to the front section; and a lateral lace hook secured to the rear section on a lateral side of the rear section and disposed above the lateral zipper when the rear section is zipped to the front section.

8. The footwear upper of claim 7, wherein:

a medial portion of the lace is engaged with the medial lace hook, a lateral portion of the lace is engaged with the lateral lace hook, and the medial portion is tied to the lateral portion between the medial lace hook and the lateral lace hook when the lace is in a tied state with the rear section is zipped to the front section.

9. The footwear upper of claim 1, further comprising:

a medial lace anchor fixed to a medial portion of the lace outward of the medial zipper pull; wherein the medial zipper pull defines an aperture through which the lace extends, and the medial lace anchor is larger than the aperture of the medial zipper pull; and a lateral lace anchor fixed to a lateral portion of the lace outward of the lateral zipper pull; wherein the lateral zipper pull defines an aperture through which the lace extends, and the lateral lace anchor is larger than the aperture of the lateral zipper pull.

10. The footwear upper of claim 1, further comprising:

a biasing member secured to the rear section and tensioned when the rear section is zipped to the front section, thereby applying a biasing force urging the rear section to an unzipped position.

11. The footwear upper of claim 10, wherein:

a rear portion of the front section defines a through-hole; and the biasing member extends through the through-hole and is secured to at least one of the front section or a sole structure secured to the front section.

12. The footwear upper of claim 11, wherein the biasing member lays against an exterior surface of the rear section when the rear section is zipped to the front section.

13. The footwear upper of claim 1, wherein:

the front section partially establishes a heel region of the footwear upper; and the rear section is secured to the front section at the heel region between the medial edge and the lateral edge of the front section.

14. The footwear upper of claim 1, wherein:

the lace-receiving feature is one of a first series of lace-receiving features on a medial side of the front section and a second series of lace-receiving features on a lateral side of the front section; and the lace extends through the first series of lace-receiving features and the second series of lace-receiving features and spans a gap therebetween.

15. The footwear upper of claim 1, wherein when the rear section is zipped to the front section, an outward force applied to a forward medial end of the rear section remote from the medial zipper pull moves the medial slider rearward along the medial edge, and an outward force applied to a forward lateral end of the rear section remote from the lateral zipper pull moves the lateral slider rearward along the lateral edge.

16. An article of footwear comprising:

a sole structure;

a footwear upper having a mule section secured to the sole structure, and an ankle support section hinged to a heel region of the mule section; wherein the mule section has a medial edge that slopes upwardly from the heel region in a forward direction of the sole structure, and a lateral edge that slopes upwardly from the heel region in the forward direction of the sole structure;

a zipper system including:

lower teeth extending along the medial edge and the lateral edge of the mule section; upper teeth extending along a proximal edge of the ankle support section; a medial slider engaged with the lower teeth and the upper teeth on a medial side of the footwear upper; a medial zipper pull engaged with the medial slider; a lateral slider engaged with the lower teeth and the upper teeth on a lateral side of the footwear upper; and a lateral zipper pull engaged with the lateral slider;

a tightening system including:

a lace-receiving feature on the mule section forward of the zipper system; and a lace extending through the lace-receiving feature, through the medial zipper pull, and through the lateral zipper pull; wherein outward forces applied to segments of the lace outward of the medial zipper pull and the lateral zipper pull move the medial slider and the lateral slider forward along the lower teeth, zipping the ankle support section to the mule section.

17. The article of footwear of claim 16, wherein:

the ankle support section pivots at the heel region between an access position in which the ankle support section is rearward of the heel region and is unzipped from the mule section, and a use position in which the ankle support section is zipped to the mule section.

18. The article of footwear of claim 16, further comprising:

a medial lace hook secured to the ankle support section on the medial side and disposed above the medial zipper pull when the ankle support section is zipped to the mule section; and a lateral lace hook secured to the ankle support section on the lateral side and disposed above the lateral zipper pull when the ankle support section is zipped to the mule section.

19. The article of footwear of claim 16, further comprising:

an elastic biasing member secured to a rear portion of the ankle support section and anchored to one of the sole structure or the mule section; wherein the elastic biasing member is tensioned when the ankle support section is zipped to the mule section, and applies a biasing force urging the ankle support section to an unzipped position.

20. The article of footwear of claim 16, wherein an outward force applied to a forward medial end of the ankle support section and remote from the medial zipper pull moves the medial slider rearward along the medial edge, and an outward force applied to a forward lateral end of the ankle support section and remote from the lateral zipper pull moves the lateral slider rearward along the lateral edge.

* * * * *